US010810941B2

(12) United States Patent
Xu

(10) Patent No.: US 10,810,941 B2
(45) Date of Patent: Oct. 20, 2020

(54) BRIGHTNESS REGULATION DEVICE OF DISPLAY DEVICE, BRIGHTNESS REGULATION METHOD AND DISPLAY DEVICE

(71) Applicant: Shenzhen China Star Optoelectronics Technology Co., Ltd., Shenzhen, Guangdong (CN)

(72) Inventor: Jing Xu, Guangdong (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 326 days.

(21) Appl. No.: 15/780,773

(22) PCT Filed: Sep. 13, 2017

(86) PCT No.: PCT/CN2017/101485
§ 371 (c)(1),
(2) Date: Jun. 1, 2018

(87) PCT Pub. No.: WO2019/033483
PCT Pub. Date: Feb. 21, 2019

(65) Prior Publication Data

US 2020/0251055 A1 Aug. 6, 2020

(30) Foreign Application Priority Data

Aug. 18, 2017 (CN) ..... 2017 1 0712371

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01);
(Continued)

(58) Field of Classification Search
CPC ..... G09G 3/3258; G09G 2320/0223; G09G 2320/0233
See application file for complete search history.

(56) References Cited

U.S. PATENT DOCUMENTS

2013/0135272 A1 5/2013 Park
2016/0365037 A1* 12/2016 Gu ..... G09G 3/3291

FOREIGN PATENT DOCUMENTS

CN 101295464 A 10/2008
CN 101859536 A 10/2010
(Continued)

*Primary Examiner* — Xuemei Zheng
(74) *Attorney, Agent, or Firm* — Leong C. Lei

(57) ABSTRACT

A brightness regulation device of a display device is disclosed. The device includes: a data converter for converting an original power voltage generated by a power voltage device into an original digital value, and converting a real-time power voltage of each pixel in multiple pixel regions into a real-time digital value; a timing controller for obtaining a difference digital value according to each real-time digital value and the original digital value, obtaining the brightness regulation coefficient according to the difference digital value, and processing an image signal inputted from an external portion according to the brightness regulation coefficient in order to generate a scanning control signal and a data control signal. A brightness regulation method of a display device and a display device are also disclosed. The present invention compensates the brightness of the pixel to decrease the IR voltage drop (IR-Drop) to improve a uniformity of the display picture.

9 Claims, 3 Drawing Sheets

(52) U.S. Cl.
CPC . *G09G 2310/0243* (2013.01); *G09G 2310/08* (2013.01); *G09G 2320/0223* (2013.01); *G09G 2320/0233* (2013.01); *G09G 2320/0626* (2013.01); *G09G 2330/021* (2013.01); *G09G 2360/16* (2013.01)

(56) References Cited

FOREIGN PATENT DOCUMENTS

| | | | | |
|---|---|---|---|---|
| CN | 101976546 | A | | 2/2011 |
| CN | 102768821 | A | | 11/2012 |
| CN | 103280188 | A | | 9/2013 |
| CN | 103996374 | A | | 8/2014 |
| CN | 104021755 | A | | 9/2014 |
| CN | 104036722 | A | | 9/2014 |
| CN | 105513541 | A | | 4/2016 |
| CN | 105931600 | A | * | 9/2016 |
| CN | 105931600 | A | | 9/2016 |
| CN | 106128359 | A | | 11/2016 |

* cited by examiner

BRIGHTNESS REGULATION DEVICE OF DISPLAY DEVICE, BRIGHTNESS REGULATION METHOD AND DISPLAY DEVICE

BACKGROUND OF THE INVENTION

1. Field of the Invention

The present invention relates a display technology field, and more particularly to a brightness regulation device of a display device, a brightness regulation method and a display device.

2. Description of Related Art

Recently, the Organic Light-Emitting Diode (OLED) display device has become a very hot and emerging flat display device at home and abroad. That is because the OLED display device has features of self-luminous, wide viewing angle, short response time, high luminous efficiency, wide color gamut, thin thickness, capable of producing a large-size and flexible display device and simple manufacturing process. Besides, the OLED display device also has a low cost potential.

In the OLED display device, a thin-film transistor (TFT) and a capacitor storage signal are adopted to control the brightness grayscale performance of the OLED. In the conventional art, the pixel of the conventional OLED display device includes two thin-film transistors (TFT) and one capacitor. Specifically, including one switching TFT T1, one driving TFT T2, and one storage capacitor Cst. Wherein, a source of the driving TFT T2 is used for receiving a power positive voltage OVDD, an cathode of the OLED is used for receiving a power negative voltage OVSS. Generally, the power positive voltage OVDD and the power negative voltage OVSS are both generated by the power voltage device. The power voltages (including the power positive voltage OVDD and the power negative voltage OVSS) generated by the power voltage device are decreased when reaching the pixels because of the trace impedance so as to generate the IR voltage drop (IR-Drop) such that an uniformity of the display picture of the OLED display device is decreased.

SUMMARY OF THE INVENTION

In order to solve the above problem existed in the conventional technology, the purpose of the present invention is to provide a brightness regulation device of a display device, a brightness regulation method and a display device, which can improve the uniformity of the display picture.

According to one aspect of the present invention, the present invention provides a brightness regulation device of a display device, comprising: a data converter for converting an original power voltage generated by a power voltage device into an original digital value, and converting a real-time power voltage of each pixel in multiple pixel regions into a real-time digital value, wherein the display device includes the pixel region and the power voltage device, the pixel region includes multiple pixel, each pixel includes an organic light-emitting diode, the power voltage device is used for generating the original power voltage, and providing the original power voltage to each pixel in the pixel region; and a timing controller for obtaining a difference digital value according to each real-time digital value and the original digital value, obtaining the brightness regulation coefficient according to the difference digital value, and processing an image signal inputted from an external portion according to the brightness regulation coefficient in order to generate a scanning control signal and a data control signal.

Furthermore, the data converter comprises: a data selection module for selecting the real-time power voltage of each pixel in one of the multiple pixel regions; and an analog to digital conversion module for respectively converting the original power voltage and the real-time power voltage of each pixel in the pixel region into an original digital value and a real-time digital value.

Furthermore, the timing controller is also used for calculating an average digital value of the real-time digital value of each pixel, and calculating a digital difference value of the average digital value and the original digital value.

Furthermore, the timing controller is also used for looking up a value corresponding to the digital difference value at a preset brightness regulation curve, and obtaining a brightness regulation coefficient according to the value.

According another aspect of the present invention, the present invention also provides a display device, comprising: multiple pixel regions, and each pixel region includes multiple pixels having organic light-emitting diodes; a power voltage device for generating an original power voltage, and providing the original power voltage to each pixel in the pixel regions; a data converter as claimed in claim 1 for obtaining a brightness regulation coefficient according to the original power voltage and real-time power voltage of each pixel in the pixel region, and generating a scanning control signal and a data control signal according to the brightness regulation coefficient; a scanning driver for providing a scanning signal to each pixel of the pixel regions according to the scanning control signal; and a data driver for providing a data signal to each pixel of the pixel regions according to the data control signal.

According another aspect of the present invention, the present invention also provides a brightness regulation method of a display device, comprising: converting an original power voltage generated by a power voltage device into an original digital value, and converting a real-time power voltage of each pixel in multiple pixel regions into a real-time digital value; wherein the display device includes the multiple pixel regions and the power voltage device, each pixel region includes multiple pixels, each pixel includes an organic light-emitting diode, the power voltage device is used for generating the original power voltage, and providing the original power voltage to each pixel of the pixel regions; obtaining a digital difference value according to the real-time digital value and the original digital value; obtaining a brightness regulation coefficient according to the digital difference value; processing an image signal inputted from an external portion according to the brightness regulation coefficient in order to generate a scanning control signal and a data control signal; and respectively generating a scanning signal and a data signal according to the scanning control signal and the data control signal.

Furthermore, the step of converting an original power voltage into an original digital value, and converting a real-time power voltage of each pixel in multiple pixel regions into a real-time digital value comprises: selecting the real-time power voltage of each pixel in one of the multiple pixel regions; and converting the original power voltage and the real-time power voltage of each pixel in the pixel region being selected into the original digital value and the real-time digital value.

Furthermore, the step of obtaining a digital difference value according to the real-time digital value and the original digital value comprises: calculating an average digital value of the real-time digital value of each pixel; and calculating a digital difference value of the average digital value and the original digital value.

Furthermore, the step of obtaining a brightness regulation coefficient according to the digital difference value comprises: looking up a value corresponding to the digital difference value at a preset brightness regulation curve, and obtaining a brightness regulation coefficient according to the value.

The beneficial effect of the present invention: the present invention can compensate the brightness of the pixel so as to decrease the IR voltage drop (IR-Drop) such that a uniformity of the display picture of the OLED display device is decreased.

BRIEF DESCRIPTION OF THE DRAWINGS

Through following to combine figures to describe in detail, the above, the other purposes, the features and benefits of the exemplary embodiment of the present disclosure will become clearer, in the figures.

DETAILED DESCRIPTION OF THE PREFERRED EMBODIMENT

The following content combines with the drawings and the embodiment for describing the present invention in detail. However, many other forms can be used to implement the present invention. Besides, the present invention should not be interpreted to be limit in the specific embodiment described here. On the contrary, the embodiments provided here are used for explaining the operation principle and practical application such that person skilled in the art can under various embodiments of the present invention and various modification suitable for specific applications.

In the figures, in order to illustrate the devices clearly, thickness of the layers and regions are enlarged. A same numeral in the entire specification and figures represents a same device.

Figure 1:
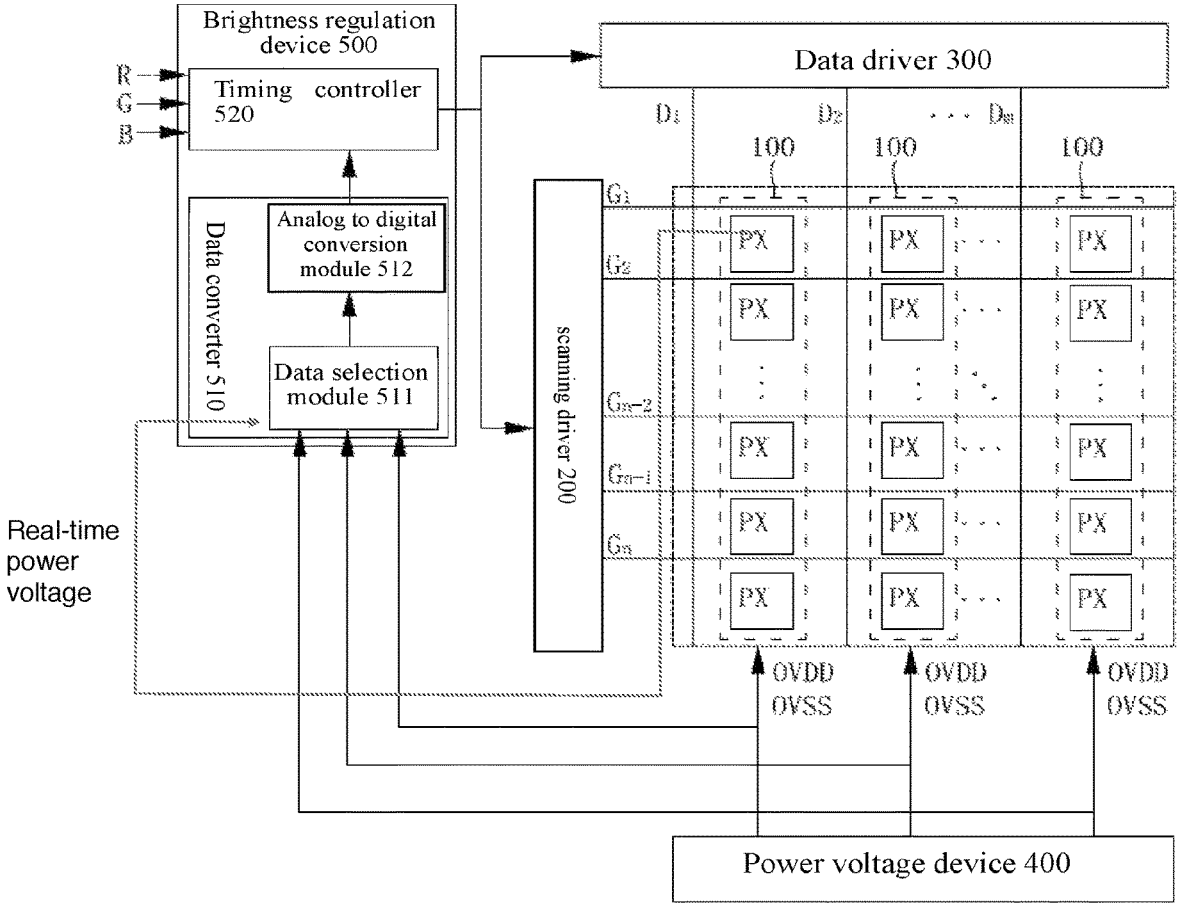
FIG. 1 is a schematic structural diagram of a display device according to an embodiment of the present invention.

FIG. 1 is a schematic structural diagram of a display device according to an embodiment of the present invention.

With reference to FIG. 1, a display device according to an embodiment of the present invention includes: multiple pixel regions 100, a scanning driver 200, a data driver 300, a power voltage device 400 and a brightness regulation device 500.

Specifically, each pixel region 100 includes multiple pixels PX. In the present embodiment, each pixel region 100 includes a column of pixels PX, however, the present invention is not limited. For example, each pixel region 100 can include a row or at least two rows of pixels PX, or at least two columns of pixels PX.

Each pixel PX is connected with display signal lines. The display signal lines can include multiple scanning lines G1 to Gn for transmitting scanning signals and multiple data lines D1 to Dm for transmitting data signals. The scanning lines G1 to Gn are extended along a row direction and are in parallel with each other. The data lines D1 to Dm are extended along a column direction and are in parallel with each other.

The scanning driver 200 is connected with the scanning lines G1 to Gn and applying scanning signals to the scanning lines G1 to Gn. The scanning signals are provided to the pixels PX through the scanning lines G1 to Gn.

The data driver 300 is connected to the data lines D1 to Dm, and applying data signals to the data lines D1 to Dm. The data signals are provided to the pixels PX through the data lines D1 to Dm.

The power voltage device 400 generates multiple power voltages. The power voltages includes a positive voltage OVDD and a negative voltage OVSS. The power voltage device 400 provides a power positive voltage OVDD and a power negative power voltage OVSS to the pixels PX.

Figure 2:
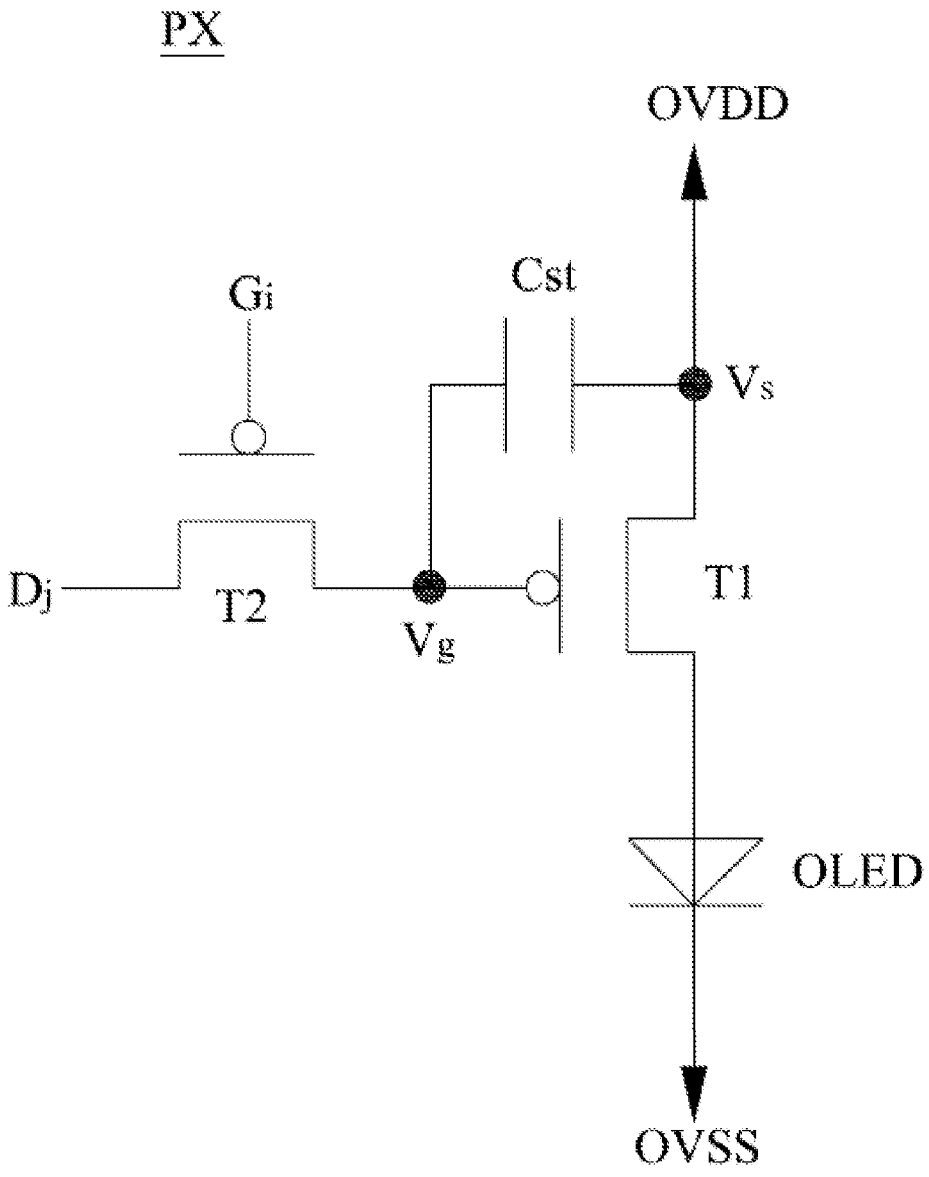
FIG. 2 is a circuit diagram of a pixel according to an embodiment of the present invention.

FIG. 2 is a circuit diagram of a pixel according to an embodiment of the present invention.

With reference to FIG. 2, the pixel PX according to the embodiment of the present invention includes: a driving thin-film transistor T1, a switching thin-film transistor T2, a storage capacitor Cst and an organic light-emitting diode OLED.

A drain electrode of the driving thin-film transistor T1 is connected to an anode of the organic light-emitting diode OLED. A source electrode of the driving thin-film transistor T1 is connected to the power voltage device 400 in order to receive the power positive voltage OVDD. A gate electrode of the driving thin-film transistor T1 is connected to the drain electrode of the switching thin-film transistor T2. The cathode of the organic light-emitting diode OLED is connected to the power voltage device 400 in order to receive the power negative voltage OVSS. A gate electrode of the switching thin-film transistor T2 is connected to the scanning line Gi ($1 \leq i \leq n$), and the source electrode of the thin-film transistor T2 is connected to the data line Dj ($1 \leq j \leq m$). The storage capacitor Cst is connected between the source electrode and the gate electrode of the driving thin-film transistor T1.

In the present embodiment, the power voltages generated by the power voltage device 400 are defined as original power voltages (original power positive voltage or original power negative voltage). When the original power voltages generated by the power voltage device 400 are provided to each of the pixels PX, because of the impedance of the traces, the original power voltages will be decreased, and the power voltages actually received by the pixels PX will be less than the original power voltages. Accordingly, the power voltages actually received by the pixels PX are defined as real-time power voltages (real-time power positive voltage and real-time power negative voltage).

With reference to FIG. 1, the brightness regulation device 500 obtains a brightness regulation coefficient according to the original power voltage and the real-time power voltages of each pixel PX in the pixel region 100, and generates the scanning control signals and the data control signals according to the brightness regulation coefficient.

Specifically, the brightness regulation device 500 includes a data converter 510 and a timing controller 520.

The data converter 510 is used for converting the original power voltages generated by the power voltage device 400 into original digital values, and converting the real-time power voltage of each pixel PX in the pixel region 100 into real-time digital values.

The timing controller 520 is used for obtaining a difference digital value according to each real-time digital value and the original digital value, and obtaining the brightness regulation coefficient according to the difference digital value.

Furthermore, the data converter 510 includes a data selection module 511 and an analog to digital conversion module 512.

The data selection module 511 is used for selecting the real-time power voltage of each pixel PX in one of the multiple pixel regions 100. The analog to digital conversion module 512 is used for converting the original power voltage and the real-time power voltage of each pixel PX in the pixel region 100 respectively into the original digital value and the real-time digital value.

Furthermore, the timing controller 520 is also used for calculating an average digital value of the real-time digital value of each pixel in the pixel region 100 being selected, and calculating a digital difference value of the average digital value and the original digital value.

The timing controller 520 is also used for looking up a value corresponding to the digital difference value at a preset brightness regulation curve, and obtaining a brightness regulation coefficient according to the value. The brightness regulation coefficient can be used for compensating the IR decreasing effect because of the decreasing of the power voltage.

Specifically, looking up a value corresponding to the digital difference value at a preset brightness regulation curve can be adopted, and a brightness regulation coefficient can be obtained according to the value.

The brightness regulation curve can be a relationship curve of the digital difference value and the brightness regulation coefficient. For example, a horizontal axis represents a digital difference value, and a vertical axis represents a brightness regulation coefficient, and obtaining the brightness regulation coefficient according to the curve.

Besides, the timing controller 520 can control an operation of the scanning driver 200 and the data driver 300.

The timing controller 520 receives an image signal (such as R, G, B signal) from an external graphic controller (not shown). The timing controller 520 appropriately process the image signal using the brightness regulation coefficient (can only process the image signals corresponding to each pixel PX in the pixel region 100) in order to generate a scanning control signal and a data control signal. Here, processing the image signal through the brightness regulation coefficient can compensate the data signal generated by the data driver 300 according to the control signal in order to compensate the brightness of the pixel PX in order to reduce the brightness uneven phenomenon of the pixels PX.

Then, the timing controller 520 transmits the scanning control signal to the scanning driver 200 and transmits the data control signal to the data driver 300. The scanning driver 200 generates the scanning signal according to the scanning control signal, the data driver 300 generates the data signal according to the data control signal.

According to the above description, the data selection module 511 selects the real-time power voltage of each pixel PX in one of the multiple pixel regions 100 in a time-division manner. Therefore, an image signal corresponding to each pixel PX in the pixel region 100 being selected can be regulated, or the brightness regulation coefficient being obtained each time can be saved until last brightness regulation coefficient is obtained. Then all of the brightness regulation coefficients are utilized to process all of the image signals.

Figure 3:
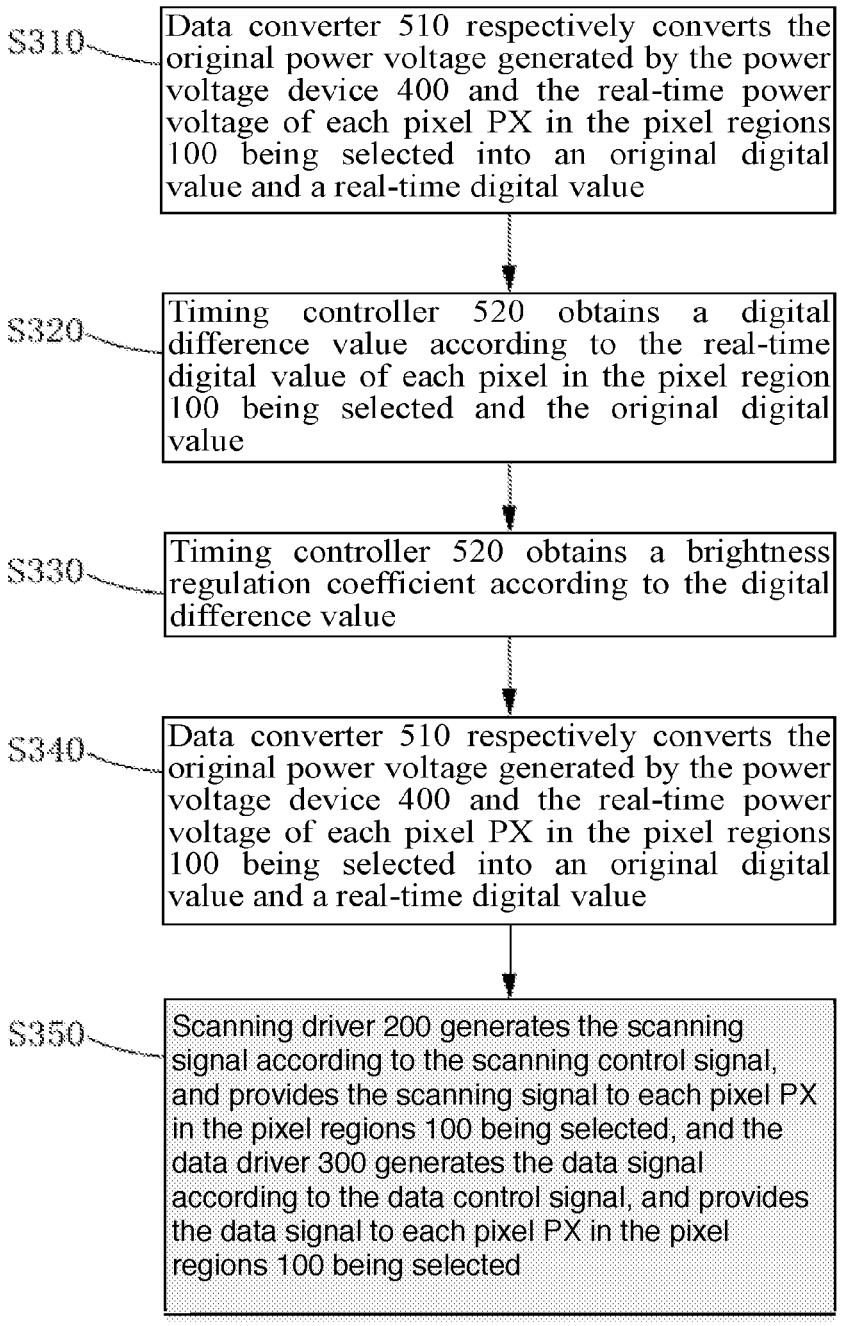
FIG. 3 is a flow chat of a brightness regulation method of a display device according to an embodiment of the present invention.

FIG. 3 is a flow chat of a brightness regulation method of a display device according to an embodiment of the present invention.

With reference to FIG. 3, the brightness regulation method of the display device according to the embodiment of the present invention includes a step S310 to a step S350.

With reference to FIG. 1 to FIG. 3, in a step S310, a data converter 510 converts an original power voltage generated by the power voltage device 400 into an original digital value, and converting a real-time power voltage of each pixel PX in the pixel regions 100 into a real-time digital value.

The specific way to realize the step S310 includes:

Firstly, the data converter 510 selects the real-time power voltage of each pixel PX in one of the multiple pixel regions 100.

Secondary, the data converter 510 respectively converts the original power voltage generated by the power voltage device 400 and the real-time power voltage of each pixel PX in the pixel regions 100 being selected into an original digital value and a real-time digital value.

In the step S320, the timing controller 520 obtains a digital difference value according to the real-time digital value of each pixel in the pixel region 100 being selected and the original digital value.

The method for realizing the step S320 includes:

firstly, the timing controller 520 calculates an average digital value of the real-time digital values.

Secondary, the timing controller 520 perform a subtraction operation to the average digital value and the original digital value in order to obtain a digital difference value.

In the step S330, the timing controller 520 obtains the brightness regulation coefficient according to the digital difference value.

Specifically, a step of looking up a value corresponding to the digital difference value at a preset brightness regulation curve, and obtaining a brightness regulation coefficient according to the value can be adopted.

The brightness regulation curve can be a relationship curve of the digital difference value and the brightness regulation coefficient. For example, a horizontal axis represents a digital difference value, and a vertical axis represents a brightness regulation coefficient, and obtaining the brightness regulation coefficient according to the curve.

In the step S340, the timing controller 520 processes an image signal inputted from an external portion according to the brightness regulation coefficient in order to generate a scanning control signal and a data control signal.

In the step S350, the scanning driver 200 generates the scanning signal according to the scanning control signal, and provides the scanning signal to each pixel PX in the pixel regions 100 being selected. The data driver 300 generates the data signal according to the data control signal, and provides the data signal to each pixel PX in the pixel regions 100 being selected.

In summary, the brightness regulation device of a display device, the brightness regulation method and the display device according to the embodiment of the present invention can compensate the brightness of the pixel PX so as to decrease the IR voltage drop (IR-Drop) such that an uniformity of the display picture of the OLED display device is decreased.

Besides, the present invention is described according to the method and the equipment (or system) of the embodiment of the present invention. It can be understood that each process and/or block, a combination of process and/or block in the flow chart and/or the block diagram can the present invention can be realized by computer program instructions and information sensing device. The computer program instructions can be provided to a general computer, application specific computer, an embedded processor or the processor of other programmable data processing equipment to execute the program instructions and cooperate with the information sensing device to realize the device having the specific function in one process or multiple processes in the flow chart and/or one block or multiple blocks on the block diagram.

Besides, each device, element or module in the display device according to an embodiment of the present invention can be realized as a hardware component. The treatment executed by the person skilled in the art according to each device, component and module can utilize a Field Programmable Gate Array (FPGA) or a Specific Integrated Circuit (ASIC) to realize each module, unit or sub-unit.

The above embodiments of the present invention are only exemplary, however, the present invention is not limited. The person skilled in the art can understand: without exceeding the principle and spirit of the present invention, the above embodiments can be changed in form and detail.

What is claimed is:

1. A brightness regulation device of a display device, comprising:

a data converter for receiving and converting an original power voltage generated by a power voltage device into an original digital value, and receiving and converting a real-time power voltage of each pixel in a pixel region into a respective real-time digital value, wherein the display device includes the pixel region and the power voltage device, the pixel region including multiple-pixels, each of the multiple pixels including an organic light-emitting diode, the power voltage device generating the original power voltage and providing the original power voltage to each of the multiple pixels in the pixel region; and a timing controller for obtaining a digital difference value according to the real-time digital values of the multiple pixels and the original digital value, obtaining a brightness regulation coefficient according to the digital difference value, and processing an image signal inputted from an external portion according to the brightness regulation coefficient in order to generate a scanning control signal and a data control signal;

wherein the timing controller calculates an average digital value of the real-time digital values of the multiple pixels, and calculating a difference value of the average digital value and the original digital value to obtain the digital difference value for determining the brightness regulation coefficient.

2. The brightness regulation device according to claim 1, wherein the data converter comprises:

a data selection module for selecting the real-time power voltage of each of the multiple pixels; and an analog to digital conversion module for respectively converting the original power voltage and the real-time power voltage of each of the multiple pixels into an original digital value and a real-time digital value.

3. The brightness regulation device according to claim 1, wherein the timing controller is also used for looking up a value corresponding to the digital difference value at a preset brightness regulation curve, and obtaining the brightness regulation coefficient according to the value.

4. A display device, comprising:

a pixel region that includes multiple pixels having organic light-emitting diodes;

a power voltage device for generating an original power voltage and providing the original power voltage to each of the multiple pixels;

a data converter as claimed in claim 1 for obtaining a brightness regulation coefficient according to the original power voltage and real-time power voltages of the multiple pixels, and generating a scanning control signal and a data control signal according to the brightness regulation coefficient;

a scanning driver for providing a scanning signal to each of the multiple pixels according to the scanning control signal; and a data driver for providing a data signal to each of the multiple pixels according to the data control signal;

wherein the timing controller is also used for calculating an average digital value of the real-time digital values of the multiple pixels, and calculating a difference value of the average digital value and the original digital value to obtain a digital difference value for determining the brightness regulation coefficient.

5. The display device according to claim 4, wherein the data converter comprises:

a data selection module for selecting the real-time power voltage of each of the multiple pixels; and an analog to digital conversion module for respectively converting the original power voltage and the real-time power voltage of each of the multiple pixels into an original digital value and a real-time digital value.

6. The display device according to claim 4, wherein the timing controller is also used for looking up a value corresponding to the digital difference value at a preset brightness regulation curve, and obtaining the brightness regulation coefficient according to the value.

7. A brightness regulation method of a display device, comprising:

converting an original power voltage generated by a power voltage device into an original digital value, and converting a real-time power voltage of each pixel in a pixel region into a respective real-time digital value, wherein the display device includes the pixel region and the power voltage device, the pixel region including multiple pixels, each of the multiple pixels including an organic light-emitting diode, the power voltage device generating the original power voltage and providing the original power voltage to each of the multiple pixels;

obtaining a digital difference value according to the real-time digital values of the multiple pixels and the original digital value;

obtaining a brightness regulation coefficient according to the digital difference value;

processing an image signal inputted from an external portion according to the brightness regulation coefficient in order to generate a scanning control signal and a data control signal; and respectively generating a scanning signal and a data control signal according to the scanning control signal and the data control signal;

wherein the step of obtaining a digital difference value according to the real-time digital values of the multiple pixels and the original digital value comprises:

calculating an average digital value of the real-time digital values of the multiple pixels; and calculating a difference value of the average digital value and the original digital value to obtain the digital difference value for determining the brightness regulation coefficient.

8. The brightness regulation method according to claim 7, wherein the step of converting an original power voltage into an original digital value, and converting a real-time power voltage of each pixel in a pixel region into a respective real-time digital value comprises:

selecting the real-time power voltage of each of the multiple pixels; and converting the original power voltage and the real-time power voltage of each being of the multiple pixels so selected into an original digital value and a real-time digital value.

9. The brightness regulation method according to claim 7, wherein the step of obtaining a brightness regulation coefficient according to the digital difference value comprises:

looking up a value corresponding to the digital difference value at a preset brightness regulation curve, and obtaining the brightness regulation coefficient according to the value.

* * * * *